US006306258B1

(12) United States Patent
Lange et al.

(10) Patent No.: US 6,306,258 B1
(45) **Date of Patent: *Oct. 23, 2001**

(54) AIR PRESS

(75) Inventors: David V. Lange; Roger A. Kanitz, both of Beloit; Richard D. Hauser, Brodhead; Patrick W. Murry; Doug A. Rounds, both of Beloit, all of WI (US); Robert L. Clarke, Roscoe, IL (US); Frank S. Hada, Appleton, WI (US); Michael A. Hermans, Neenah, WI (US); Charles R. Tomsovic, Omro, WI (US)

(73) Assignees: Metso Paper, Inc., Helsinki (FI); Mitsubishi Heavy Industries, Ltd., Tokyo (JP); Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/670,151

(22) Filed: Sep. 26, 2000

Related U.S. Application Data

(63) Continuation of application No. 08/962,110, filed on Oct. 31, 1997, now abandoned.

(51) Int. Cl.[7] ..... D21F 5/14

(52) U.S. Cl. ..... 162/290; 34/634; 162/301; 162/353; 162/359.1

(58) Field of Search ..... 162/290, 301, 162/310, 351, 353, 358.1, 359.1, 371; 34/452, 634; 277/906

(56) References Cited

U.S. PATENT DOCUMENTS

| | | | | |
|---|---|---|---|---|
| 1,767,889 | * | 6/1930 | Jurgensen | 162/290 |
| 3,284,285 | * | 11/1966 | Holden | 162/290 |
| 3,771,236 | * | 11/1973 | Candor et al. | 34/452 |
| 4,787,641 | * | 11/1988 | Rautakorpi et al. | 162/371 |
| 5,225,042 | * | 7/1993 | Eaton et al. | 162/203 |
| 6,093,284 | * | 7/2000 | Hada et al. | 162/290 |
| 6,143,135 | * | 11/2000 | Hada et al. | 162/290 |

* cited by examiner

*Primary Examiner*—Karen M. Hastings
(74) *Attorney, Agent, or Firm*—Lathrop & Clark LLP

(57) ABSTRACT

A pressurized box is positioned opposite a vacuum box. The pressurized box has a leading cross machine direction baffle with a ceramic shoe which engages a forming fabric, and a trailing cross machine direction baffle of similar construction. Two end deckles complete the pressurized box. The leading cross machine direction baffle presses against a resilient seal which causes a web contained between upper and lower forming fabrics to wrap about the baffle shoe a few degrees forming an effective end seal which does not allow air to bypass the baffle. The trailing cross machine direction baffle is positioned over a vacuum box which prevents air from leaking around the trailing baffle. A vacuum box draws air through the forming fabrics and the web, from the pressurized box increasing the total pressure gradient across the web to 20 to 30 psi or more. The pressure box and opposed vacuum box form an air press. The pressure box is positioned and held against the forming fabrics by opposing air tubes. An alternative embodiment utilizes a suction roll positioned beneath the pressure box and having a suction gland positioned beneath the portion of the roll which backs the pressure box.

17 Claims, 2 Drawing Sheets

AIR PRESS

This application is a continuation of U.S. Ser. No. 08/962,110 filed on Oct. 31, 1997, now abandoned.

FIELD OF THE INVENTION

The present invention relates to apparatus for removing water from a paper web in general and to apparatus which draw air through a web in particular.

BACKGROUND OF THE INVENTION

Paper is formed from a stock containing less than one percent paper fibers by weight. The fibers contained in the stock are deposited on a forming fabric and a web is formed by draining water from the stock through the forming fabric. In many modem papermaking machines stock is injected between two forming fabrics in a so-called twin wire former. The web, however formed, is dewatered in three sections of the papermaking machine. The sections are referred to as the forming section, the pressing section, and the drying section. The paper web typically leaves the forming section with a fiber content of ten to twenty-five percent fiber by weight. The-paper web leaves the pressing section with a fiber content of between thirty-five and forty-five percent fiber by weight. Finally the paper web is dried to about ninety-five percent fiber dry weight in the drying section.

The direction of progress in the papermaking industry is to improve paper quality while reducing cost. Cost is reduced by increasing the speed at which paper is manufactured and by decreasing the amount of fiber required for a web with selected properties. Costs are also reduced by decreasing the amount of energy used in forming and drying the paper web. Quality is improved by better control over fiber supply, and the processes used in forming the finished paper.

Greater speed complicates the control of the processes by which the paper web is dried. Thus greater machine speeds drive a search for new and better processes.

Water removed in the drying section is the most costly water removed from a paper web. If a paper web is formed from stock containing one percent fiber, then approximately 99 pounds of water must be removed to form one pound of finished paper web. The last pound of water removed from a paper web which is being formed, which represents taking the web from fifty percent dry weight to ninety-five percent dry weight, is typically accomplished by evaporation in the drying section of a papermaking machine. This last pound of water costs as much to remove as the first ninety-eight pounds.

Thus methods of improving the dewatering processes in the forming section and pressing section are to be sought. In the pressing section the use of extended nip presses and high temperature pressing techniques has increased the amount of water which can be removed by a combination of pressure and temperature. In the forming section, where water is typically removed by drainage and vacuum, new methods of increasing water removal are needed.

One approach is to pass air through the web to draw or blow water from between the fibers which form the web. Air can be drawn by a vacuum, but vacuum has two limitations. First, the process takes place in Earth's atmosphere, and thus the maximum vacuum is limited to less than sea level pressure. Second, practical and cost considerations limit the cost-effective levels of vacuum obtainable in practice to considerably less than 14.7 psi.

The use of vacuum to draw water from a paper web is a fairly straightforward process. A box is placed on the side of a forming fabric opposite a paper web and air is drawn from the box. The low pressure pulls the forming fabric against the box forming a seal. The vacuum also controls the amount of pressure or force with which the forming fabric presses against the box and any fabric supports bridging the box.

If pressure is used, sealing the pressurized box to the web can be a problem. If the box is held against the forming fabric with insufficient force, air will leak around the box, causing a loss of air and possibly disrupting the web by blowing along the plane of the web. If too much force is used to hold the box against the forming fabric, excessive wear of the fabric results. The fabrics used to form the paper web are expensive and premature replacement of the forming fabrics results in additional costs caused by the lack of productivity while the machine is down. Unlike vacuum, which supplies its own clamping force, pressure requires a separate system to develop the sealing force.

Part of the answer is disclosed in U.S. Pat. No. 5,225,042 to Eaton et al. which discloses how a seal can be formed by pressing a sealing member against an unsupported portion of a forming fabric. Eaton et al. discloses a system useful for pressures to about ten psi. Further, Eaton et al. shows a gravity drain system opposite the pressure box.

Certain grades of paper, such as tissue paper or creped papers are typically formed by pressing the web onto a large diameter Yankee dryer, and creating a soft absorbent web by scraping the web off the dryer surface with a doctor blade. Alternative approaches hold out the possibility of increasing absorbency while overcoming the limitations of using a single large diameter Yankee dryer. If a web can be dried without pressing, an absorbent web can be formed without creping the web with a doctor blade. New approaches may lead to more cost-effective approaches to manufacturing these important and widely used grades of paper.

Critical to improving the manufacture of tissue paper without creping is an ability to reduce water content in the web as formed without compressing the web. The process of supplying high pressure air and vacuum simultaneously to the web in the forming section has the possibility of reducing web water content by three to five or more percent. This represents a significant reduction in cost compared with removing the same water by techniques which are solely dependent on evaporation for reducing the water content of the web.

What is needed is an apparatus which removes water from a paper web with high pressure air which does not disrupt the web and does not lead to excessive wear of the forming fabrics.

SUMMARY OF THE INVENTION

An air press for dewatering a web comprises a pressurized box which is positioned opposite a vacuum box. The pressurized box consists of a leading cross machine direction baffle with a ceramic shoe which engages a forming fabric, and a trailing cross machine direction baffle of similar construction. Two end deckles formed of high density polyethylene complete the pressurized box. The leading cross machine direction baffle presses against a resilient seal which causes a web contained between upper and lower forming fabrics to wrap about the baffle shoe a few degrees. This wrapping, in combination with a resilient foam backing or an applied vacuum, forms an effective seal which does not allow air to bypass the baffle. The trailing cross machine direction baffle is positioned over a vacuum box which prevent air from leaking around the trailing baffle. Between and opposite the leading and trailing baffles, a vacuum box draws air from the pressurized box and through the forming fabrics and the web, increasing the total pressure gradient across the web to 20 to 30 psi or more. The pressure box and opposed vacuum box form an air press. The pressure box is positioned and held against the forming fabrics by opposing air tubes.

An alternative embodiment air press utilizes a suction roll positioned beneath the pressure box and having a suction gland positioned beneath the portion of the roll which backs the pressure box.

The upper and lower forming fabrics diverge after the air press and the path of the web is controlled by a transfer slot into which the trailing baffle is positioned.

It is a feature of the present invention to provide a means for dewatering a paper web in the forming section of a papermaking machine.

It is a further feature of the present invention to provide a forming section which produces a paper web having a three to six percent greater fiber dry weight than conventional forming sections.

It is another feature of the present invention to provide an air press which will not cause excessive wear on forming fabrics passing through the air press.

It is also a feature of the present invention to provide an apparatus for sealing a pressurized box to a forming fabric without excessive wear of the forming fabric.

It is an additional feature of the present invention to provide a pressurized box loading system which is not prone to crashing into the forming fabrics.

Further objects, features and advantages of the invention will be apparent from the following detailed description when taken in conjunction with the accompanying drawings.

DESCRIPTION OF THE PREFERRED EMBODIMENT

Figure 1:
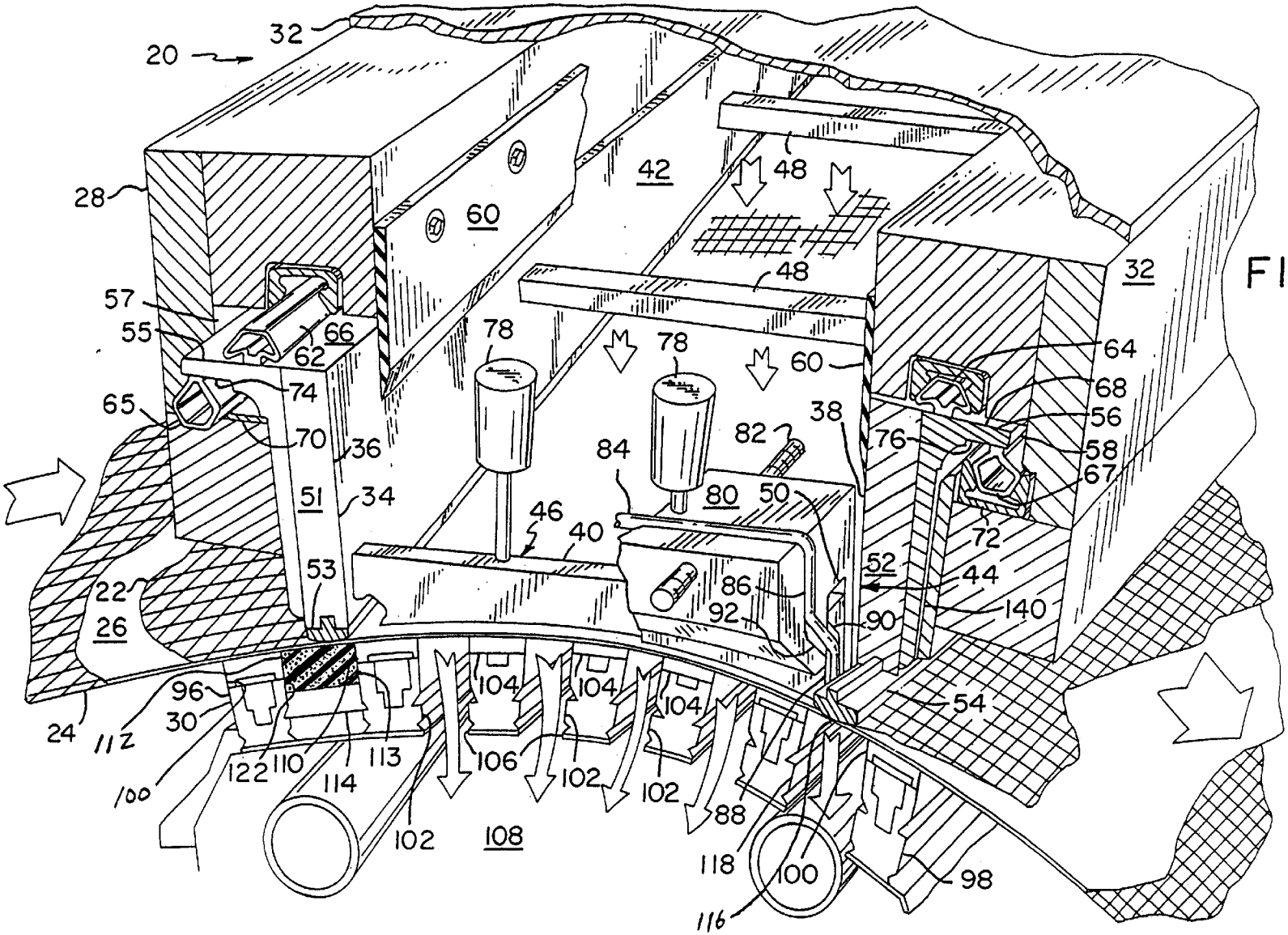
FIG. 1 is an cutaway isometric view of the air press of this invention.
Figure 2:
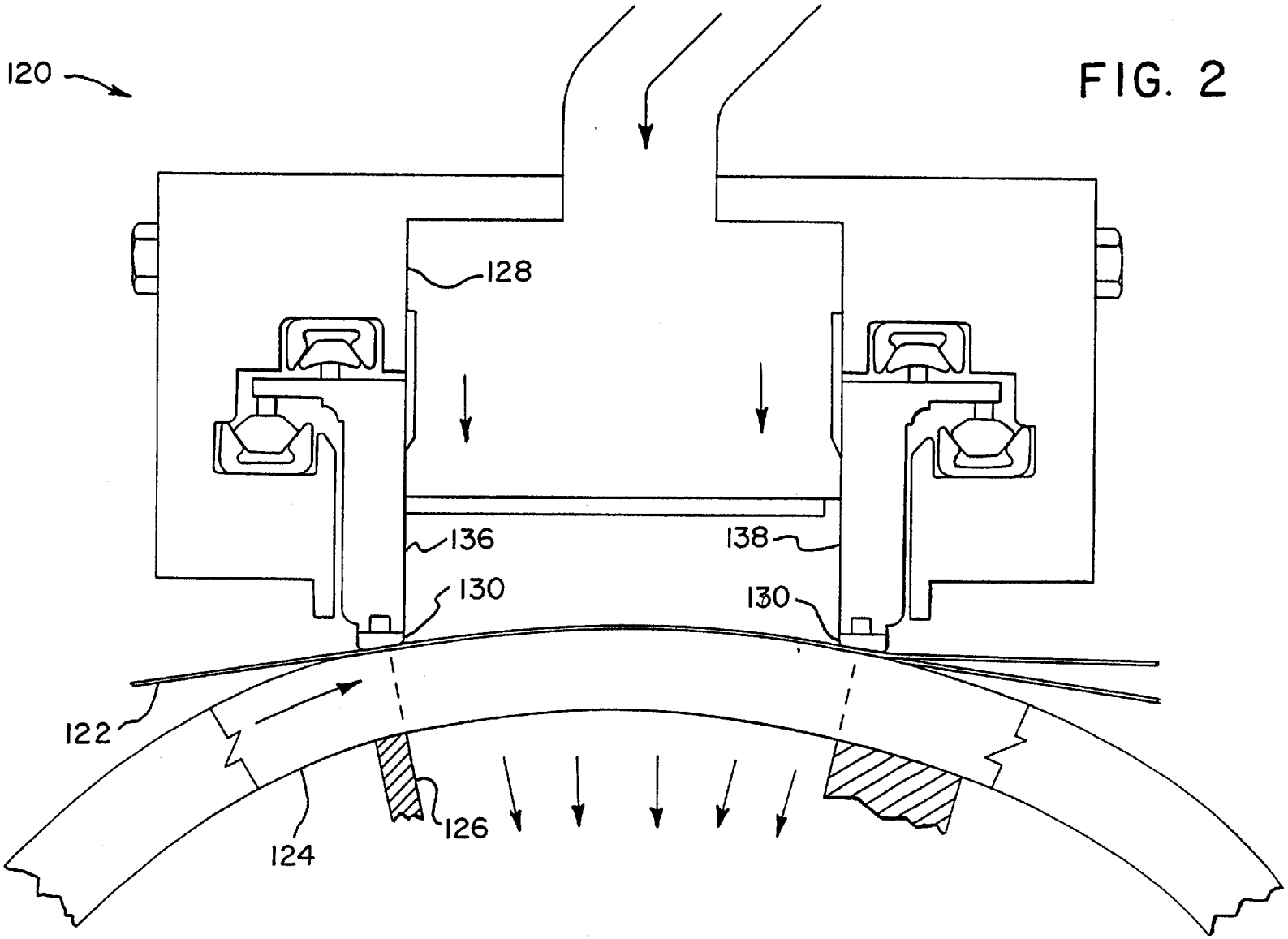
FIG. 2 is a cross-sectional view of an alternative embodiment of the air press of this invention, wherein a vacuum roll is opposed to a pressure box.

Referring more particularly to FIGS. 1–2, wherein like numbers refer to similar parts, an air press 20 is shown in FIG. 1. The air press 20 is positioned about an upper forming fabric 22 and a lower forming fabric 24 and a web 26 positioned therebetween. The air press comprises a pressure box 28 positioned above the upper forming fabric 22 and a vacuum box 30 positioned below the lower forming fabric 24. Air is supplied to the pressure box 28 and flows through the relatively permeable upper forming fabric 22, through the web 26, and finally through the relatively permeable lower forming fabric 24.

The large volume of the pressure box 28 means that air flows with relatively low velocity and a relatively high pressure of about fifteen to thirty psi through the web 26 as it passes between the pressure box 28 and the vacuum box 30. Pressure in the vacuum box 30 is typically about fifteen inches of Mercury below atmospheric or about seven psi vacuum. Thus the total pressure drop across the web 26 is approximately twenty to thirty-five psi and almost all the pressure drop occurs through the web 26 thickness. The web 26 is relatively thin, approximately a few hundredths of an inch or less, and thus the pressure drop across the web is one to a few thousand psi per inch.

The effect of the rapid expansion of air as it passes through the web 26 is to remove water from the web. A prior art air press device used on a tissue web having a solids content of about twenty-five percent and a thickness of about three hundredths of an inch was able to increase the solids content to approximately thirty-three percent. While these levels of water removal are desirable, the mechanical lever employed in the prior art device to urge the pressure box against the web can result in web breakage in the event of pressure loss. Although the precise mechanism is not clearly understood, the use of pressurized air is more effective than vacuum alone because of the higher pressures available and the greater air volume forced through the web. Prior art air presses have two basic problems: establishing an adequate seal between the pressure box and the forming fabrics without causing excessive wear of the forming fabrics; and controlling the loading of the pressure box against the fabric. A pressure of twenty psi with an area of six inches by 200 inches results in a force of 12 tons caused by the pressure in the box which must be counterbalanced. If a mechanical lever arm is used to allow movement of the pressure box, and if pressure in the box is suddenly released for any reason, such as a web break, which allows rapid venting through the fabrics, the pressure box can be driven into the forming fabrics with destructive results.

The pressure box 28 of this invention overcomes these problems by having a frame 32 which is rigidly mounted with respect to the forming fabrics, 22, 24. An opened sided box 34 is mounted to the frame 32. The top of the box 34 is open so that the box does not have to support the pressure directly away from the forming fabrics 22, 24. The box 34 is constructed of a leading cross machine direction baffle 36 and a trailing cross machine direction baffle 38 and two end deckles 40 which extend in the machine direction. The baffles 36, 38 and deckles 40 are mounted for movement towards and away from the forming fabrics 22, 24. The pressure within the box 34 acts only against the inwardly facing sides 42, 44 of the baffles 36, 38 and the inwardly facing sides 46 of the deckles 40. The leading baffle 36 is structurally tied by cross beams 48 to the trailing baffle 38 so that the forces developed by the pressure in the box 34 on the baffles 36, 38 are statically equal and are carried by the cross beams 48.

The width of the deckles 40 is only about 6 inches in a typical application and therefore the loads developed are small, a few hundred pounds, and can be resisted by using thick deckles which are supported in wide piston slots 50.

The baffles 36, 38, as shown in FIG. 1, have an L-shape, with the long legs 51, 52 of the L terminating in ceramic shoes 53, 54 which each ride in a pocket formed by the vacuum box 30 as discussed below. The short legs 55, 56 are mounted in cavities is 57, 58 in the frame 32. The cavities 57, 58 are sealed from the interior of the box 34 by flexible flaps 60 which are attached to the frame 32 and extend downwardly over the interior surfaces 42, 46 allowing motion between the box 34 and the frame 32. By preventing pressure from the interior of the pressure box 28 from acting on any horizontal surface, the pressure interior to the pressure box 28 does not load or move the baffles 36, 38 towards or away from the forming fabrics 22, 24.

The loading of the ceramic shoes 53, 54 and the movement of the inner box 34 is controlled by pairs of opposed air tube. Upper air tubes 62, 64 move the baffles 36, 38 downwardly by expanding between upwardly facing surfaces 66, 68 of the short legs 55, 56. Lower air tubes 65, 67 move the baffles 36, 38 upwardly away from the forming fabrics 22, 24 by expanding between portions 70, 72 of the frame 32 and downwardly facing surfaces 74, 76 of the short legs 55, 56 of the baffle 36, 38.

The upper air tubes 62, 64 and lower air tubes 65, 67 are connected to a source of compressed air (not shown) and a controller (not shown) which controls the force with which the baffles 36, 38 are pressed against the upper forming fabric 22. The L-shaped baffles 36, 38 have some cross machine direction flexibility which allows them to conform to the forming fabrics 22, 24.

The end deckles 40 are supported by double acting air cylinders 78 which can raise and lower the deckles 40 into engagement with the forming fabrics 22, 24. The deckles 40 and the structure 80 in which the piston slots 50 are formed can be mounted on machine screws 82 so that the end deckles 40 may be adjustably positioned for paper webs of different widths. Because of the high pressure contained in the pressure box 28, sealing between the deckles 40 and the baffles 36, 38 is critical. As shown in FIG. 1 a cylindrical rubber seal member 84 in grooves 86 in the sides 88 of the deckle 40 forms a pressure seal with the sides of the baffles 36, 38. To allow movement of the deckles 40 in the piston slots 50 an enlarged groove 90 in the piston and an enlarged groove 92 in the deckle support structure 80 allows movement of the deckles 40 while maintaining a seal with the baffles 36, 38.

The pressure box 28 is positioned over the vacuum box 30. The vacuum box 30 has a leading cross machine direction side 96 and a trailing cross machine direction side 98, the sides have ceramic shoes 100 which engage the lower forming fabric 24. A plurality of cross machine direction intermediate supports 102 are positioned between the leading and trailing vacuum box sides 96, 98. The intermediate supports 102 have ceramic shoes 104 which engage and support the lower forming fabric 24. Gaps 106 between the intermediate supports open into a vacuum duct 108.

A pocket 110 formed between the leading side 96 and the first intermediate support 113 is shown filled by a resilient foam 112 which is supported by a solid support 114. The shoe 53 of the leading edge baffle 36 is loaded by the upper air tube 62 which causes the shoe 53 to slightly depress the upper and lower forming fabrics 22, 24 and the web 26 sandwiched therebetween. The amount of deflection is adjusted depending on the fabric tensions and the type of web being formed (tissue, paper, linerboard) and the pressure in the pressure box 28, so that a good seal is formed which prevents air leaks and air blowing through the web 26.

A transfer slot 116 is formed between the trailing side 98 of the vacuum box and the last intermediate support 118. The trailing baffle 38 is moved by the upper air tube 62 which causes the shoe 54 to slightly depress the upper and lower forming fabrics 22, 24 and the web 26 sandwiched therebetween. To effect a good seal between the fabrics and the trailing baffle 38, a vacuum beneath the transfer slot 116 is necessary. In addition, for the slot 116 to effectively transfer the web to the lower forming fabric 24, vacuum must be applied to the lower fabric as it is pulled away from the upper fabric 22. The amount of vacuum beneath the transfer slot 116 should not be too high preferably about five inches of mercury below atmospheric as opposed to the fifteen inches of mercury in the vacuum box 30. If the vacuum is to high in can pull the web 26 and the lower forming fabric 24 away from the upper fabric 22. A separate source (not shown) of lower vacuum is therefore connected to the transfer slot 116.

An alternative embodiment air press 120 is shown in FIG. 2. As the machine direction width of an air press is increased, the amount of friction drag between the lower forming fabric and the vacuum box increases. The air press 120 can be used to form linerboard. As the web being dried increases in thickness, the time over which it can be usefully devolatized by remaining in the air press increases. The increased width can result in unacceptable drag forces between the lower forming fabric 122 and a vacuum box. The air press 120 employs a vacuum roll 124 which has a foraminous surface through which air can be drawn. A gland 126 is positioned within the roll 124 and remains stationary beneath the upper pressurized box 128. The upper pressurized box 128 is similar to the pressurized box 28 and utilizes a design which provides gentle constant loading of ceramic shoes 130 mounted on cross machine direction leading and trailing baffles 136, 138.

It should be understood that for some webs and machine conditions it may be desirable to dispense with the resilient foam 112 and the solid support 114 positioned in the pocket 110 as shown in FIG. 1 and simply use the vacuum to form the seal. If this is the case the amount of vacuum applied to the seal should be about five inches of mercury below atmospheric which is substantially less than the fifteen inches of mercury below atmospheric applied to the vacuum box 30.

It should also be understood that the leading baffle and trailing baffle would not necessarily have to be tied together. If each baffle is allowed to move independently then the total height of the inside surfaces of the baffles should be minimized to minimize lateral loads which the outside plates 140 shown in FIG. 1 would be required to support. Lateral bearings made from low friction surfaces of ultra high density polyurethane or the like could be used to minimize the force necessary to move the baffles towards and away from the forming fabrics.

It should be understood that tension in the forming fabrics is typically in the range of from about 10 to about 60 pounds per linear inch and in particular, tensions in the range of around forty pounds per linear inch may be desirable. The forming fabrics can be any fabric permeable to air, for example Albany International 94M, Appleton Mills 2164B or the like.

The air which is supplied to the pressurized box may be heated to reduce its viscosity and thus increase its ability to flow through the paper web. Secondary benefits of heating the air may be some additional drying capability. Gases other than air should be understood to be included in the term "air." Gases like combustion gases and other waste gases are most likely to be available.

It should be understood that key to making an air press function is an ability to seal the pressurized source of air to the forming fabrics without excessively loading the web so as to cause wear or permanent deformation of the fabrics. It is also important that loading of the fabrics does not increase significantly if a paper break or other malfunction causes air to be rapidly vented from the pressurized box. The position of a vacuum box or vacuum roll beneath the pressurized box is also important in effecting a good seal around the baffles making up the pressurized box.

It should be understood that if the endless loops of the forming fabrics have seams where the ends of the fabric are joined, the design of the air press must accommodate the passage of the thicker joints, as does the apparatus shown in FIG. 1.

It is understood that the invention is not limited to the particular construction and arrangement of parts herein illustrated and described, but embraces such modified forms thereof as come within the scope of the following claims.

We claim:

1. An apparatus for removing water from a web formed of fibers comprising:

a first forming fabric which is permeable to air;

a second forming fabric which is permeable to air;

a web of fibers containing between about ten and about forty percent fibers dry weight and about ninety to about sixty percent water, the web being positioned and held between the first forming fabric and the second forming fabric;

a first box rigidly mounted with respect to the first forming fabric and connected to a source of pressurized air;

a plurality of baffles extending between the box and the first forming fabric and defining an area of the first forming fabric, the plurality of baffles extending into the first box so as to seal the source of pressurized air to the area of the first forming fabric, the baffles being substantially devoid of surfaces on which pressure in the first box acts in a way to force the baffles towards or against the first forming fabric;

a seal formed between the plurality of baffles and the first box so that air supplied to the first box is substantially constrained to flow through the first forming fabric, the web of fibers and the second forming fabric;

a means for urging each of the baffles towards the first forming fabric; and a means for drawing a vacuum positioned adjacent to the second forming fabric, the vacuum means engaging the second forming fabric over an area which at least encompasses substantially all of an area opposite the area of the first forming fabric which is sealed to the source of pressurized air; wherein the vacuum means comprises a vacuum box with a plurality of cross machine direction forming fabric supports, at least two of said cross machine direction forming fabric supports defining a pocket into which the first forming fabric and second forming fabric and web are urged by at least one of said plurality of baffles overlying the first forming fabric, the pocket defining a seal, and wherein the pocket is filled with a resilient material and underlain by a rigid support.

2. The apparatus of claim 1 wherein the plurality of baffles comprises:

a first cross machine direction baffle;

a second cross machine direction baffle; and two machine direction baffles which define a second rectangular box with the first cross machine direction baffle and the second cross machine direction baffle, the second box opening to the first forming fabric on one side and the first box on the second side.

3. The apparatus of claim 2 wherein a resilient sealing member is positioned in a groove formed in one of said machine direction baffles to seal pressurized air within the plurality of baffles.

4. The apparatus of claim 3 wherein the groove has portions which accommodate the resilient sealing member when the machine direction baffles move upwardly.

5. The apparatus of claim 2 wherein the two cross machine direction baffles are joined to each other by structural beams which balance loads which the supply of pressurized air exerts on said cross machine direction baffles.

6. The apparatus of claim 1 wherein at least one of said plurality of baffles has a ceramic shoe which engages the first forming fabric.

7. The apparatus of claim 1 wherein the means for urging the plurality of baffles towards the first forming fabric includes an inflatable air tube.

8. The apparatus of claim 2 wherein the cross machine direction baffles have flanges extending parallel to the first forming fabric and further include first means acting on the flanges for urging the cross machine direction baffles towards the first forming fabric and further including second means acting on the flanges for urging the cross machine direction baffles away from the first forming fabric.

9. The apparatus of claim 1 further comprising a means for urging the plurality of baffles away from the first forming fabric.

10. An apparatus for removing water from a web formed of fibers and held between opposed forming fabrics, the apparatus comprising:

a first forming fabric which is permeable to air;

a second forming fabric which is permeable to air;

a first box fixed with respect to the first forming fabric and connected to a source of pressurized air;

a plurality of baffles extending between the box and the first forming fabric and defining a first area of the first forming fabric, the plurality of baffles extending into the first box to seal the source of pressurized air to the first area of the first forming fabric;

a seal formed between the plurality of baffles and the first box so that air supplied to the first box is substantially constrained to flow through the first forming fabric, the web of fibers and the second forming fabric, wherein the plurality of baffles are positioned in the first box and sealed to the first box by the seals so that air pressure in the first box does not act on the baffles to urge the baffles towards or away from the forming fabric;

an actuator extending between each baffle of the plurality of baffles and the first box to move the baffles towards and away from the first forming fabric; and a structure positioned adjacent to a second area defined on the second forming fabric, the structure drawing a vacuum on the second forming fabric over the second area which at least encompasses substantially all of an area opposite the first area of the first forming fabric which is sealed to the source of pressurized air, wherein the structure positioned adjacent to the second area on the second forming fabric is a vacuum box with a plurality of cross machine direction forming fabric supports, at least two of said cross machine direction forming fabric supports defining a pocket into which the first forming fabric and second forming fabric are urged by at least one of said plurality of baffles overlying the first forming fabric, the pocket defining a seal, and wherein the pocket is filled with a resilient material and underlain by a rigid support.

11. The apparatus of claim 10 wherein the plurality of baffles comprises:

a first cross machine direction baffle;

a second cross machine direction baffle; and two machine direction baffles which defining a second rectangular box with the first cross machine direction baffle and the second cross machine baffle, the second box opening to the first forming fabric on one side and to the first box on the second side.

12. The apparatus of claim 10 wherein a resilient sealing member is positioned in a groove formed in one of said machine direction baffles to seal pressurized air within the plurality of baffles.

13. The apparatus of claim 12 wherein the groove has portions which accommodate the resilient sealing member when the machine direction baffles move upwardly.

14. The apparatus of claim 10 wherein at least one of said plurality of baffles has a ceramic shoe which engages the first forming fabric.

15. The apparatus of claim 10 wherein the two cross machine direction baffles are joined to each other by structural beams which balance loads which the supply of pressurized air exerts on said cross machine direction baffles.

16. The apparatus of claim 10 wherein the actuator which moves the plurality of baffles towards and away from the first forming fabric includes an inflatable air tube.

17. The apparatus of claim 12 wherein the cross machine direction baffles have flanges extending parallel to the first forming fabric and further include first air tubes acting on the flanges for urging the cross machine direction baffles towards the first forming fabric and further including second air tubes acting on the flanges for urging the cross machine direction baffles away from the first forming fabric.

* * * * *